US007450870B2

(12) United States Patent
Iio et al.

(10) Patent No.: US 7,450,870 B2
(45) Date of Patent: Nov. 11, 2008

(54) DEVELOPING DEVICE USING ONE-COMPONENT TONER FOR AN IMAGE FORMING APPARATUS, AND A PROCESS CARTRIDGE INCLUDING THE DEVELOPING DEVICE

(75) Inventors: Masato Iio, Kanagawa-ken (JP); Osamu Endou, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/563,299

(22) Filed: Nov. 27, 2006

(65) Prior Publication Data

US 2007/0086812 A1 Apr. 19, 2007

Related U.S. Application Data

(62) Division of application No. 10/762,254, filed on Jan. 23, 2004, now abandoned.

(30) Foreign Application Priority Data

Jan. 23, 2003 (JP) ..... 2003-014705
Mar. 7, 2003 (JP) ..... 2003-062560

(51) Int. Cl.
*G03G 15/08* (2006.01)

(52) U.S. Cl. ..... 399/43; 399/53; 399/284

(58) Field of Classification Search ..... 399/27, 399/29, 43, 53, 226, 228, 257, 274, 284, 399/12, 13
See application file for complete search history.

(56) References Cited

U.S. PATENT DOCUMENTS 4,995,710 A 2/1991 Suzuki et al.
5,005,928 A 4/1991 Suzuki et al.
5,128,795 A 7/1992 Endou et al.
5,157,534 A 10/1992 Endou et al.
5,161,047 A 11/1992 Tomita et al.
5,168,293 A * 12/1992 Ogasawara et al. ..... 347/131
5,233,454 A 8/1993 Sakuma et al.
5,408,095 A 4/1995 Atsuumi et al.
5,426,298 A 6/1995 Sakuma et al.

(Continued)

FOREIGN PATENT DOCUMENTS

EP 1 162 514 12/2001

(Continued)

OTHER PUBLICATIONS

U.S. Appl. No. 12/099,482, filed Apr. 8, 2008, Endou.

*Primary Examiner*—Robert Beatty
(74) *Attorney, Agent, or Firm*—Oblon, Spivak, McClelland, Maier & Neustadt, P.C.

(57) ABSTRACT

A developing device includes a toner supplying roller, a developing roller for transferring the one-component toner to a developing position by performing a developing rotation in an image forming operation and moving away from the developing position, a sealing member arranged in a vicinity of the developing roller, and a toner layer regulating roller arranged in contact with the developing roller for locking a rotating operation in the image forming operation, for regulating the one-component toner which adheres on a surface of the developing roller into a thin layer and for freely following the developing roller in a non-image forming operation. A compulsory toner consumption operation is performed to supply toner onto the image bearing member after termination of the non-image forming operation.

8 Claims, 7 Drawing Sheets

U.S. PATENT DOCUMENTS 5,557,448 A 9/1996 Endo et al.
5,570,224 A 10/1996 Endo et al.
5,606,408 A 2/1997 Yano et al.
5,740,494 A 4/1998 Shoji et al.
5,805,324 A 9/1998 Endou
5,955,228 A 9/1999 Sakai et al.
6,398,345 B1 6/2002 Sakai et al.
6,519,437 B1 2/2003 Aoki et al.
6,643,486 B1 11/2003 Endoh et al.
6,766,121 B2 * 7/2004 Nonaka et al. ..... 399/24
6,775,506 B2 8/2004 Endoh et al.
6,792,218 B2 * 9/2004 Tungate et al. ..... 399/29
6,795,673 B2 9/2004 Yoshizawa
6,795,674 B2 9/2004 Endoh et al.
7,095,966 B2 * 8/2006 Adachi ..... 399/27

FOREIGN PATENT DOCUMENTS

JP 06-138729 5/1994
JP 09-90742 4/1997
JP 11 84867 3/1999
JP 2001-56607 2/2001
JP 2001-255710 9/2001
JP 2002-182470 6/2002
JP 2002182470 A 6/2002
JP 2002 268380 A 9/2002
JP 2002 311707 A 10/2002
JP 2002-333769 11/2002
JP 2002365908 A 12/2002

* cited by examiner

DEVELOPING DEVICE USING ONE-COMPONENT TONER FOR AN IMAGE FORMING APPARATUS, AND A PROCESS CARTRIDGE INCLUDING THE DEVELOPING DEVICE

CROSS REFERENCE TO RELATED APPLICATIONS

The present application is a divisional of application Ser. No. 10/762,254 filed Jan. 23, 2004 and claims priority under 35 U.S.C. § 119 to Japanese Patent Applications No. 2003-014705 filed on Jan. 23, 2003 and No. 2003-062560 filed on Mar. 7, 2003 in the Japanese Patent Office, the entire contents of which are incorporated herein by reference.

BACKGROUND OF THE INVENTION

1. Field of the Invention

The present invention relates to a developing device and a process cartridge, and more particularly to a developing device using one-component toner for an electrophotographic image forming apparatus, and to a process cartridge including the developing device.

2. Discussion of the Background

A developing device using one-component toner is provided to an electrophotographic image forming apparatus such as a printer, copier, facsimile machine and the like. The developing device generally includes a toner layer regulating member and a developing roller for frictionally charging toner at a nip portion formed between the toner layer regulating member and the developing roller and forming a toner layer having a predetermined height.

The toner layer regulating member generally has two types: a blade member and a doctor roller.

The blade member is widely used in a conventional developing device. When the developing roller is a hard roller formed by metal or resin, the blade member is made of elastic material such as a urethane rubber. On the other hand, when the developing roller is made of elastic material such as rubber, the blade member is a metal blade and the like. Such developing device using one-component toner does not require developer carriers and a toner density sensor while a developing device using two-component toner does. Therefore, when the blade member is provided and a process linear velocity is relatively low, the developing device using one-component toner can be made at a relatively low cost.

However, in recent years, an image forming apparatus is required to increase a speed of image forming operations. That is, the developing device using one-component toner is also required to increase the process linear velocity and to extend an operating life. Since the blade member is held in contact with the developing roller by pressure, the surface of the developing roller is gradually worn away with age, and charge ability of the developing roller deteriorates. The deterioration of the charge ability reduces a toner charge volume so that background contamination may occur and small dot reproducibility may be decreased. Further, the toner accumulated at the nip portion of the developing roller may melt by frictional heat caused between the developing roller and the blade member. Then, the melted toner coagulates and forms a toner lump which may cause a white streak on an image. Therefore, it has seemed to be difficult to produce a developing device having a long-term durability.

To eliminate the drawbacks, the doctor roller is used instead of the blade member. The doctor roller remains stopped while the developing device is forming an image and is rotated with the developing roller while the developing device is not forming an image. This reduces toner coagulation at a nip portion and background contamination due to aging.

FIG. 1 shows structures of another developing device including the doctor roller. The developing device forms a developing device 1 including a developing roller 2, a doctor roller 3 serving as a toner layer regulating member for regulating a toner layer and applying a voltage to toner, a toner supplying roller 4, a toner conveyance member 5, a toner scraping member 6 for scraping toner adhering to a surface of the doctor roller 3, an inlet seal 7 provided in contact with an upper portion of the developing roller 2 for preventing the toner from blowing out from the developing device 1, and a toner hopper 8 serving as a case of the developing device 1 for preventing a leakage of the toner. The developing roller 2 of the developing device 1 is held in contact with a photoconductive belt 9 serving as a belt-shaped photoconductive element. The photoconductive belt 9 forms an electrostatic latent image on a surface thereof and moves in a direction A. The developing device 1 produces a full-color image through the following operations.

Toner is contained in the toner hopper 8. The toner conveyance member 5 rotates so that the toner is agitated and conveyed to the toner supplying roller 4. The toner supplying roller 4 is formed by a metal core and a foamed material such as polyurethane, silicon, EPDM, polycarbonate and the like. The toner supplying roller 4 is held in contact with the developing roller 2 and rotates clockwise or counterclockwise at a speed having a relative linear velocity difference with respect to the developing roller 2. The toner supplying roller 4 carries the toner and rubs it onto a surface of the developing roller 2 at a nip portion formed between the developing roller 2 and the toner supplying roller 4. The toner is preliminarily charged and is supplied to the developing roller 4 via a nip formed between the developing roller 2 and the doctor roller 3. The doctor roller 3 contacts the developing roller 2 by applying a pressure with a predetermined weight.

The toner supplied by the toner supplying roller 4 to the developing roller 2 passes through the nip between the developing roller 2 and the doctor roller 3 so that an amount of toner pass is regulated. This prevents the toner from being unevenly distributed to a thrust direction on the surface of the developing roller 2 and regulates to form a uniform toner layer on the surface thereof. Further, when the toner passes through the nip formed between the developing roller 2 and the doctor roller 3, the surfaces of the developing roller 2 and the doctor roller 3 are rubbed to cause a friction, and the toner is stably charged and is transferred onto a photoconductive belt 9. As a result, the electrostatic latent image is visualized and is conveyed for a next step of producing the full-color image.

When the toner is transferred onto the photoconductive belt 9, the photoconductive belt 9 travels in the direction A as shown in FIG. 1 and the developing roller 2 rotates in a direction B. That is, the developing roller 2 and the photoconductive belt 9 move in a same direction. Further, the developing roller 2 rotates at a speed 1.1 through 2.0 times faster than the speed of the photoconductive belt 9.

When the developing roller 2 is made of elastic material, the doctor roller 3 may be a hard roller, and vise versa. Generally, the doctor roller 3 employs an elastic base material such as a rubber. In that condition, when the developing roller 2 and the doctor roller 3 are left in contact without the toner between them for a long period of time, the rollers 2 and 3 may stick to each other and, as a result, a starting torque of the developing device may increase to cause damage or failure to a drive part such as a gear, a drive motor and the like.

SUMMARY OF THE INVENTION

The present invention has been made in view of the above circumstances. It is an object of the present invention to provide a novel developing device which eliminates the above-described condition.

It is another object of the present invention to provide a process cartridge including an image bearing member and the novel developing device.

In one exemplary embodiment, a developing device includes a toner supplying roller, a developing roller, a sealing member and a toner layer regulating roller. The toner supplying roller is configured to supply a one-component toner for developing an image. The developing roller is configured to transfer the one-component toner to a developing position by performing a developing rotation in an image forming operation and to move away from the developing position. The sealing member which is arranged in a vicinity of the developing roller is configured to seal the one-component toner within the developing device. The toner layer regulating roller which is arranged in contact with the developing roller is configured to lock a rotating operation in the image forming operation, to regulate the one-component toner which adheres on a surface of the developing roller into a thin layer and to freely follow the developing roller in a non-image forming operation.

The developing roller may perform the developing rotation subsequently after the reverse rotation in the non-image forming operation.

The developing roller may sequentially perform the reverse rotation and the developing rotation in the non-image forming operation of a setup operation of the developing device.

The developing roller sequentially may perform the reverse rotation and the developing rotation in the non-image forming operation after the developing roller is unused for a period longer than a predetermined period.

The developing roller may perform the reverse rotation in the non-image forming operation during a time that a non-toner covered region of the developing roller passes by the developing position.

The rotation number of the developing roller in the non-image forming operation may be smaller than the rotation number of the developing roller in the image forming operation.

Further, in one example, a method of image developing includes the steps of providing a developing device which includes a developing roller, arranging the developing roller at a developing position to perform an image developing, moving the developing roller away from the developing position in a non-image forming operation, causing the developing roller to sequentially perform a reverse rotation and a developing rotation, and setting the developing roller back to the developing position.

The above-described method of image developing may further include the steps of detecting whether the developing device is new, and carrying out the steps of providing, arranging, moving, causing and setting when the developing device is detected as new.

The above-described method of image developing may further include the steps of detecting whether the developing device is unused for a period longer than a predetermined period, and carrying out the steps of providing, arranging, moving, causing and setting when the developing device is unused for the period longer than the predetermined period.

The developing roller may perform the reverse rotation in the non-image forming operation during a time that a non-toner covered region of the developing roller passes by the developing position.

The rotation number of the developing roller in the non-image forming operation may be smaller than the rotation number of the developing roller in the image forming operation.

Further, in one example, a process cartridge includes an image bearing member, and a developing device which includes a toner supplying roller, a developing roller, a sealing member and a toner layer regulating roller. The toner supplying roller is configured to supply a one-component toner for developing an image. The developing roller is configured to transfer the one-component toner to a developing position by performing a developing rotation in an image forming operation and to move away from the developing position. The sealing member which is arranged in a vicinity of the developing roller and is configured to seal the one-component toner within the developing device. The toner layer regulating roller which is arranged in contact with the developing roller and is configured to lock a rotating operation in the image forming operation, to regulate the one-component toner which adheres on a surface of the developing roller into a thin layer and to freely follow the developing roller in a non-image forming operation.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
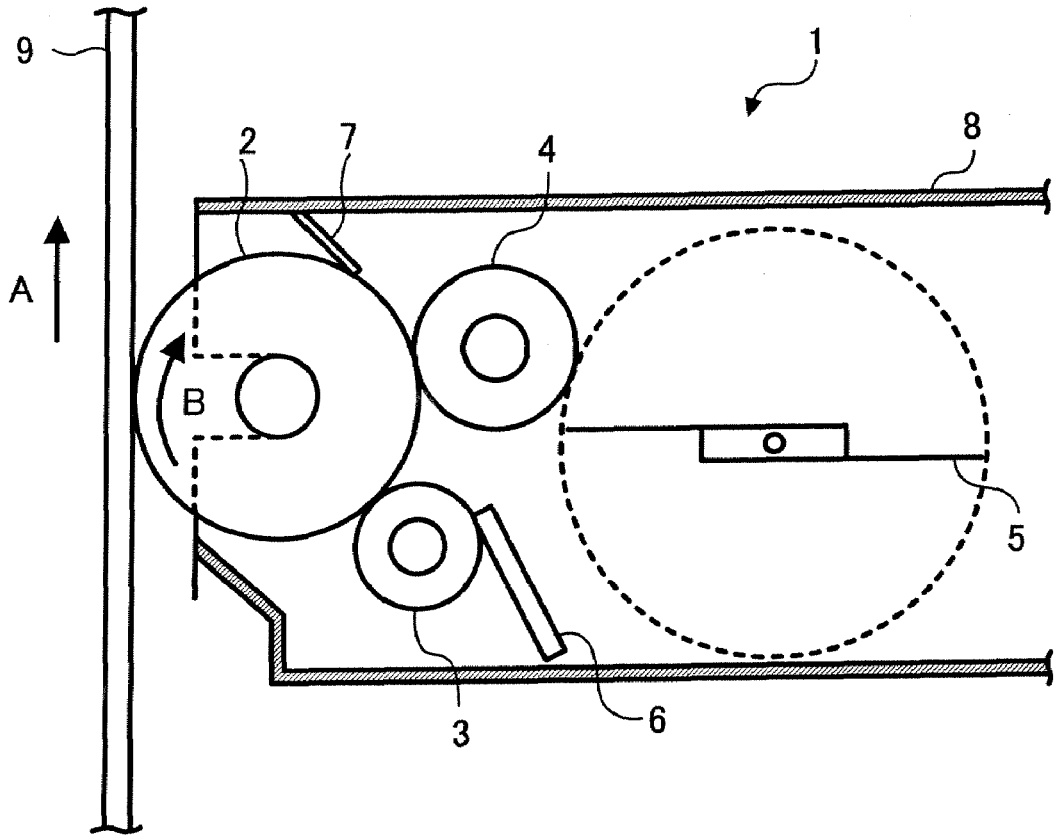
FIG. 1 PRIOR ART
FIG. 1 is a sectional view of a background developing device.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
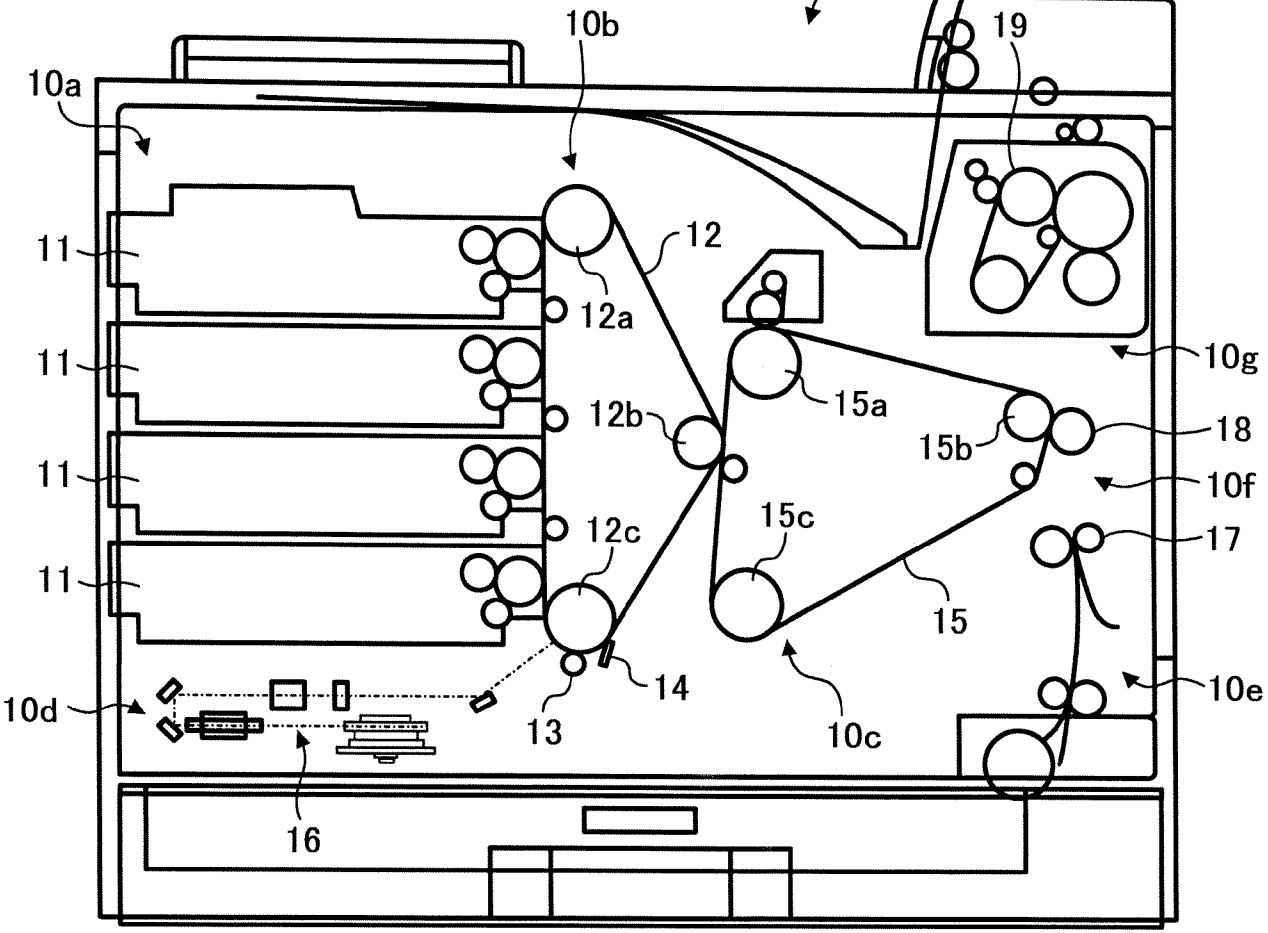
FIG. 2 is a vertical sectional view of an image forming apparatus including developing devices according to an exemplary embodiment of the present invention.

Referring now to the drawings, wherein like reference numerals designate identical or corresponding parts throughout the several views, particularly to FIG. 2, a color laser printer 10 formed as one example of an image forming apparatus according to an exemplary embodiment of the present invention is explained.

The color laser printer 10 of FIG. 2 includes a developing portion 10*a*, an image bearing portion 10*b*, an intermediate transfer portion 10*c*, an optical writing portion 10*d*, a sheet feeding portion 10*e*, a final transfer portion 10*f*, and a fixing portion 10*g*.

The developing portion 10*a* includes four developing devices 11. The developing devices 11 serve as developing devices of the color laser printer 10 and accommodate respective toners of different colors. Each of the developing devices 11 is independently detachable with respect to the color laser printer 10. The developing devices 11 have identical structures to each other but with toners of different colors. Therefore, the detailed explanations below focus on the operations performed by one of the developing devices 11 (see FIGS. 3, 4 and 6).

The image bearing portion 10*b* includes a photoconductive belt 12 having a surface formed by an organic photoconductive layer. The photoconductive belt 12 is supported by a plurality of supporting rollers 12*a*, 12*b*, 12*c* and the like. In the vicinity of the supporting roller 12*c*, a charging unit 13 and a photoconductive element cleaning unit 14 are arranged to be held in contact with the photoconductive belt 12. The charging unit 13 is applied with a high voltage to uniformly charge the photoconductive belt 12. The photoconductive element cleaning unit 13 removes residual toner on the surface of the photoconductive belt 12.

The intermediate transfer portion 10*c* includes an intermediate transfer belt 15. The intermediate transfer belt 15 is supported by a plurality of supporting rollers 15*a*, 15*b*, 15*c* and the like. The intermediate transfer belt 15 is held in contact with the photoconductive belt 12.

The optical writing portion 10*d* includes an optical writing unit 16. The optical writing unit 16 is provided to a lower left portion, which is a position under the developing devices 11.

The sheet feeding portion 10*e* includes a conveyance roller 17 for conveying a recording medium to the final transfer portion 10*f*.

The final transfer portion 10*f* includes a sheet transfer roller 18. The sheet transfer roller 18 is held in contact with the intermediate transfer belt 15.

The fixing portion 10*g* includes a fixing unit 19. The fixing unit 19 is provided to a position above the final transfer portion 10*f*.

The color laser printer 10 produces a full-color image through the following operations. The color laser printer 10 receives color image data such as color image signals from a computer (not shown). The color image signals include color image signals BK (black), C (cyan), M (magenta) and Y (yellow). The optical writing unit 16 of the color laser printer 10 converts the color image signals into optical signals according to the respective colors of the color image signals BK, C, M and Y. The optical writing unit 16 then uses a laser to write an electrostatic latent image on the photoconductive belt 12. The optical writing unit 16 writes one electrostatic latent image at a time for one of respective colors of the color image signals BK, C, M and Y.

The electrostatic latent image is conveyed to an area in which the developing devices 11 contact the photoconductive belt 12. The photoconductive belt 12 is uniformly charged by the charging unit 13. The developing devices 11 contain toners of different colors BK, C, M and Y. Each of the toners is applied with a charge having a polarity opposite to that of the electrostatic latent image formed on the photoconductive belt 12. The developing devices 11 electrically adsorb the toners onto the electrostatic latent image for forming a toner image based on the electrostatic latent image. Residual toner on the photoconductive belt 12 is removed by the photoconductive element cleaning unit 14.

The toner image formed on the photoconductive belt 12 is then conveyed to an area in which the photoconductive belt 12 contacts the intermediate transfer belt 15. The intermediate transfer belt 15 is applied with a charge having a polarity opposite to that of the toners of the toner image. Therefore, the toner image formed on the photoconductive belt 12 is transferred onto the intermediate transfer belt 15 in the area they are held in contact with each other.

The color laser printer 10 repeats the operation of forming the electrostatic latent image on the photoconductive belt 12 four times before performing the operation of transferring the toner image onto the intermediate transfer belt 15 so that toner images of different colors are sequentially overlaid on the intermediate transfer belt 15 to form a superimposed toner image.

To transfer the superimposed toner image, a recording medium is conveyed by the conveyance roller 17 in synchronization with a movement of the superimposed toner image towards a transfer area formed between the supporting roller 15*b* of the intermediate transfer belt 15 and the sheet transfer roller 18. The sheet transfer roller 18 is applied with a charge having a polarity opposite to that of the toners of the superimposed toner image. The recording medium having the superimposed toner image is conveyed to the fixing unit 19 to fixedly fuse and adhere the superimposed toner image onto the recording medium. The recording medium is then output to a discharging tray (not shown) of the color laser printer 10.

Figure 3:
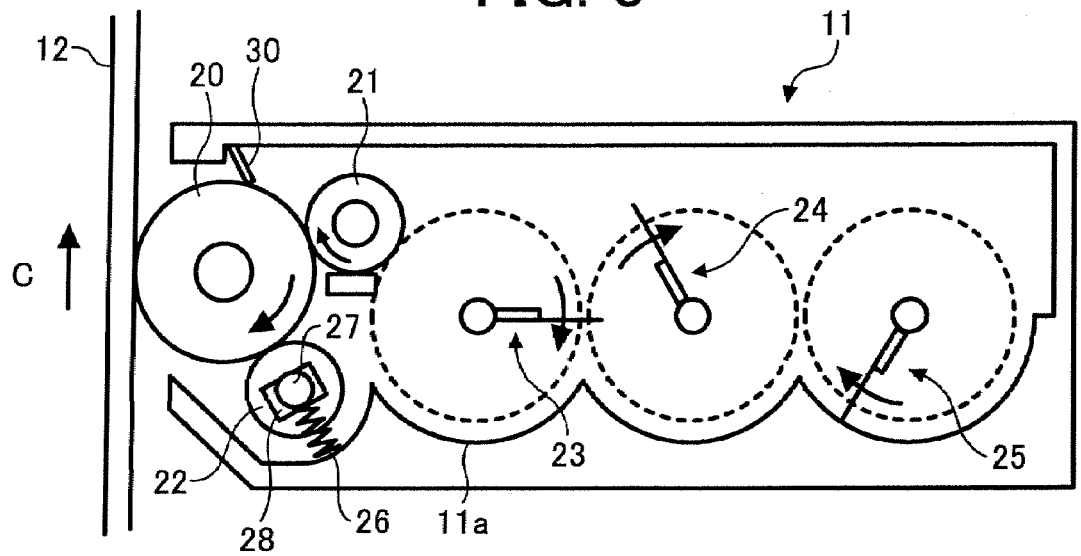
FIG. 3 is a sectional view of one of the developing devices included in the image forming apparatus of FIG. 1 when the developing devices perform image forming.

Referring now to FIG. 3, operations of the developing device 11 are explained when the developing device 11 is forming an image, that is, the developing device 11 is in an "image forming operation". As described above, the explanations in this section focus on the operations performed by one of the developing devices 11.

The developing device 11 according to the embodiment of the present invention includes a developing roller 20, a supplying roller 21, a doctor roller 22, a first toner conveyance paddle 23, a second toner conveyance paddle 24, a third toner conveyance paddle 25, and an inlet seal 30.

The supplying roller 21 is made by a foamed polyurethane.

The doctor roller 22 serving as a toner layer regulating member includes a spring 26, an one-way clutch 27 and a housing 28. The spring 26 is arranged to press the doctor roller 22 to be held in contact constantly with the developing roller 20. The one-way clutch 27 is encased by the housing 28 and controls a rotation of the doctor roller 22. When the developing device 11 is in the image forming operation, the one-way clutch locks the doctor roller 22 so that the doctor roller 22 is not rotated with the developing roller 20.

The first, second and third toner conveyance paddles 23, 24 and 25 are made by soft and elastic material such as polypropylene. The toner conveyance paddles 23, 24 and 25 having elasticity can stick fast to an inner wall of the developing device 11 and surely convey toner accommodated in the developing device 11 toward the developing roller 20.

The following description shows an image forming mechanism of the developing device in FIG. 3.

The first, second and third toner conveyance paddles 23, 24 and 25 rotate in directions as indicated by arrows. The toner conveyance paddles 23, 24 and 25 agitate toner accommodated in the developing device 11 and convey it toward the developing roller 20. The developing roller 20 of FIG. 3 rotates clockwise. This clockwise rotation of the developing roller 20 is hereinafter referred to as a "developing rotation". The conveyed toner travels to the supporting roller 21 and then to the developing roller 20. The doctor roller 22 applies a voltage to the toner supplied onto the developing roller 20 and regulates the toner to form a thin layer. The toner is transferred onto the photoconductive belt 12 to visualize the electrostatic latent image formed on the photoconductive belt 12. Toner scraped by the doctor roller 22 is conveyed along a gutter-shaped floor 11*a* of the developing device 11 and is brought back to a portion in which the first toner conveyance paddle 23 rotates.

The developing device 11 of FIG. 3 also includes a contact-separation cam (not shown) and a separation spring (not shown). The contact-separation cam is provided to a portion in the vicinity of the third toner conveyance paddle 25. The contact-separation cam rotates so that the developing roller 20 is held in contact with the photoconductive belt 12. The separation belt separates the developing roller 20 and the photoconductive belt 12. The operation as described above allows the developing device 11 to selectively contact and separate from the photoconductive belt 12.

Figure 4:
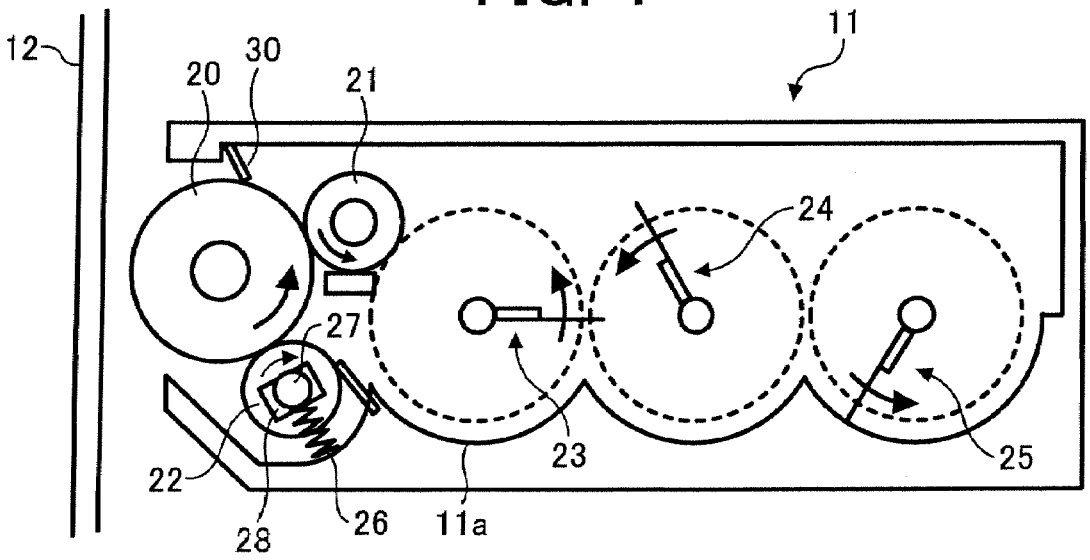
FIG. 4 is a sectional view of one of the developing devices included in the image forming apparatus of FIG. 1 when the developing devices do not perform image forming.

Referring to FIG. 4, operations of the developing device 11 are explained when the developing device 11 is not forming an image, that is, when the developing device is in a "non-image forming operation".

When the color laser printer 10 of FIG. 2 is in the non-image forming operation, the developing device 11 is separated from the photoconductive belt 12 and the developing roller 20 is controlled to rotate counterclockwise. This counterclockwise rotation of the developing roller 20 is hereinafter referred to as a "reverse rotation". At this time, the doctor roller 22 which is usually locked by the one-way clutch 27 in the image forming operation is rotated with the developing roller 20 in a direction as indicated by an arrow. This operation of rotating the doctor roller 22 is hereinafter referred to as a "doctor rotation operation". More specifically, as described in FIG. 3, the doctor roller 22 includes the one-way clutch 27 and the housing 28 to control the rotation of the doctor roller 22. The one-way clutch 27 is provided at one end of an axis of the doctor roller 22 and is forcibly inserted into the housing 28.

The toner supplying roller 21 is controlled to rotate counterclockwise in the non-image forming operation so that it removes the toner adhering on the surface of the developing roller 20 and prevents a toner scattering to the outside of the developing device 11. Further, the first, second and third toner conveyance paddles 23, 24 and 25 are controlled to rotate counterclockwise in the non-image forming operation so that the paddles 23, 24 and 25 convey the toner removed from the surface of the developing roller 20 by the toner supplying roller 21 toward the third toner conveyance paddle 25 to prevent the toner from being accumulated in the vicinity of the developing roller 20.

Each of the developing devices 11 further includes a device checking mechanism including an ID chip and a photo sensor which are not shown, for example, for mechanically determining whether the developing device 11 itself is new when the doctor rotation operation is performed, which is explained below with reference to FIG. 5.

Figure 5:
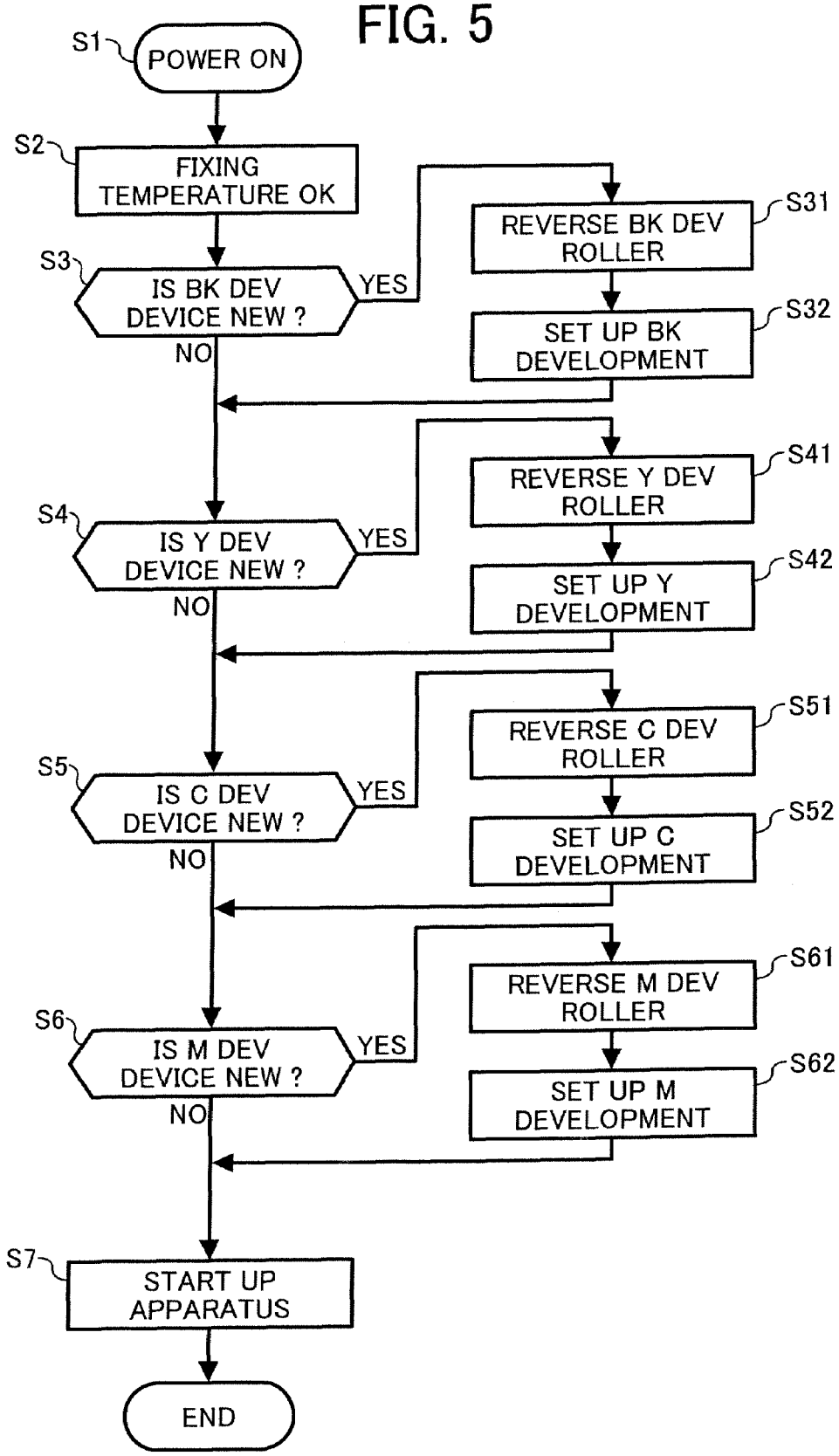
FIG. 5 is a flowchart of operations for setting up the developing devices of FIG. 2.

Referring to FIG. 5, a setup operation performed by the color laser printer 10 for setting up the developing devices 11 of the color laser printer 10 are explained. The setup operation is required to avoid an abrupt increase of the starting torque at the reverse rotation of the developing roller 20. In a case where the developing roller 20 is held in contact with the doctor roller 22 for a long period without toner in between because the developing device 11 is new or has not been used for a period longer than a predetermined period, the rollers 20 and 22 may stick to each other and the starting torque increases at a start of the image forming operation.

A flowchart of FIG. 5 shows the setup operation of the developing devices 11 performed as a case such as an initial operation where the developing devices 11 are new, for example, after a factory shipment of the color laser printer 10 or after a replacement of one or a plurality of the developing devices 11. However, the setup operation performed in the flowchart may be applied to a case such as an initial operation where the developing devices 11 have not been used for the period longer than the predetermined period, for example, after a recovery from a standby mode of the color laser printer 10 or at a first power on time in a day.

The color laser printer 10 is powered on in Step S1 and a fixing temperature is confirmed that it has reached a predetermined degree for fixing toner in Step S2. After Step S2 is performed, the device checking mechanism determines whether the developing device 11 accommodating black toner is new in Step S3. When it is determined as new, a procedure goes to Step S31. The developing roller 20 of the developing device 11 accommodating black toner performs the reverse rotation in Step S31 and then performs the developing rotation in Step S32. After Step S32 is performed, the procedure goes to Step S4. When the developing device 11 accommodating black toner is determined as not new, the procedure goes to Step S4. In Step S4, the device checking mechanism determines whether the developing device 11 accommodating yellow toner is new. When it is determined as new, the procedure goes to Step S41. The developing roller 20 of the developing device 11 accommodating yellow toner performs the reverse rotation in Step S41 and then performs the developing rotation in Step S42. After Step S42 is performed, the procedure goes to Step S5. When the developing device 11 accommodating yellow toner is determined as not new, the procedure goes to Step S5. In Step S5, the device checking mechanism determines whether the developing device 11 accommodating cyan toner is new. When it is determined as new, the procedure goes to Step S51. The developing roller 20 of the developing device 11 accommodating cyan toner performs the reverse rotation in Step S51 and then performs the developing rotation in Step S52. After Step S52 is performed, the procedure goes to Step S6. When the developing device 11 accommodating cyan toner is determined as not new, the procedure goes to Step S6. In Step S6, the device checking mechanism determines whether the developing device 11 accommodating magenta toner is new. When it is determined as new, the procedure goes to Step S61. The developing roller 20 of the developing device 11 accommodating magenta toner performs the reverse rotation in Step S61 and then performs the developing rotation in Step S62. After Step S62 is performed, the procedure goes to Step S7. When the developing device 11 accommodating magenta toner is determined as not new, the procedure goes to Step S7. In Step S7, the color laser printer 10 is started. The setup operation as described above avoids the abrupt increase of the starting torque of the developing roller 20.

Figure 6:
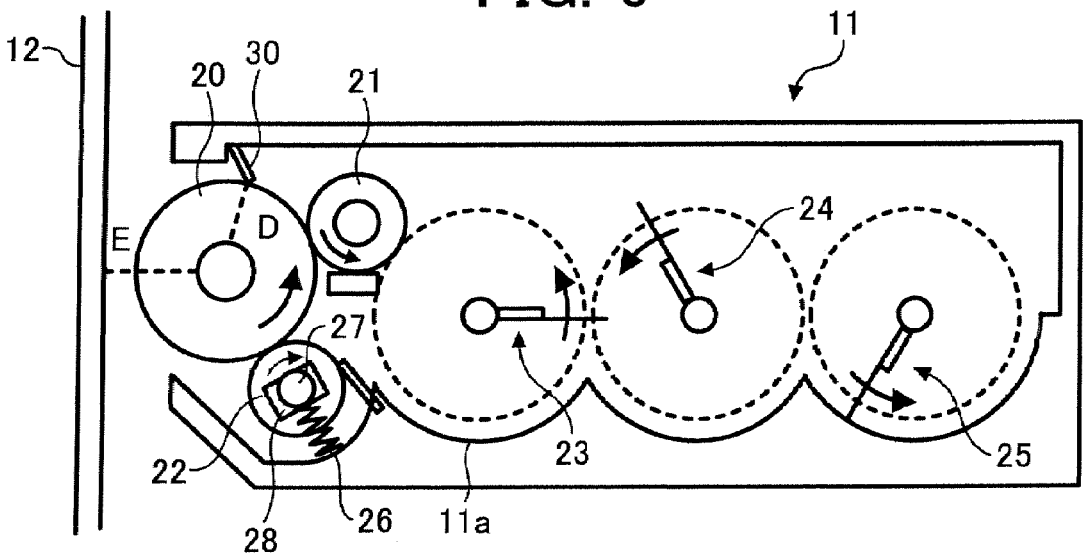
FIG. 6 is a sectional view of the developing device of FIG. 4 showing a range of a reverse rotation of a developing roller.

Referring to FIG. 6, a range of the reverse rotation of the developing roller 20 is described according to the developing device 11 of the present invention. A dotted line D shows a position the inlet seal 30 contacts a surface of the developing roller 20. The position indicates a boundary between an area the toner adheres onto the surface of the developing roller 20 and the other area no toner adheres onto the surface of the developing roller 20. A dotted line E shows a developing position where the toner on the surface of the developing roller 20 has just been transferred onto the photoconductive belt 12. The developing position also indicates the boundary of the area the toner adheres onto the surface of the developing roller 20 and the area no toner adheres onto the surface of the developing roller 20. A preferable moving range of the developing roller 20 in the reverse rotation is within the area no toner adheres on the surface of the developing roller 20, starting from the dotted line D and ending in the dotted line E. A surface of the developing roller 20 between the boundaries indicated by the dotted lines D and E is referred to as a non-toner covered region. Thus, a background contamination caused by the toner with inferior frictional charge may be prevented.

As shown in FIG. 6, when the developing roller 20 performs the reverse rotation, the inlet seal 30 contacting the surface of the developing roller 20 is pressed in a counter direction of the rotation of the developing roller 20. Therefore, the developing roller 20 performs the developing rotation after the reverse rotation. Through the operation as described above, a toner layer in a predetermined area on the surface of the developing roller 20 passes the inlet seal 30 in the reverse rotation and then passes the inlet seal 30 again in the developing rotation. This makes the toner layer uniformly formed and a charge of the toner layer remain stable. Therefore, the developing rotation after the reverse rotation is mandatory in the non-image forming operation.

When the developing device 11 is new or unused for the period longer than the predetermined period, a rotation number of the reverse rotation of the developing roller 20 is preferably smaller than that of the developing rotation thereof in the image forming operation. This prevents an overcurrent flow to a drive motor of the developing roller 20 and a failure of the drive motor.

When the developing roller 20 performs a cycle of the reverse rotation and the developing rotation in the non-image forming operation of the developing device 11, the doctor roller 22 may preferably be rotated with the developing roller 20 at intervals that a predetermined number of printout sheets is output. For example, the doctor roller 22 may be rotated after the last sheet of a print job is output or every time a predetermined amount of sheets are printed during a print job for producing a great amount of printouts. The operation as described above may not affect a speed of sequential printing and may prevent the white streak on the image.

Figure 7:
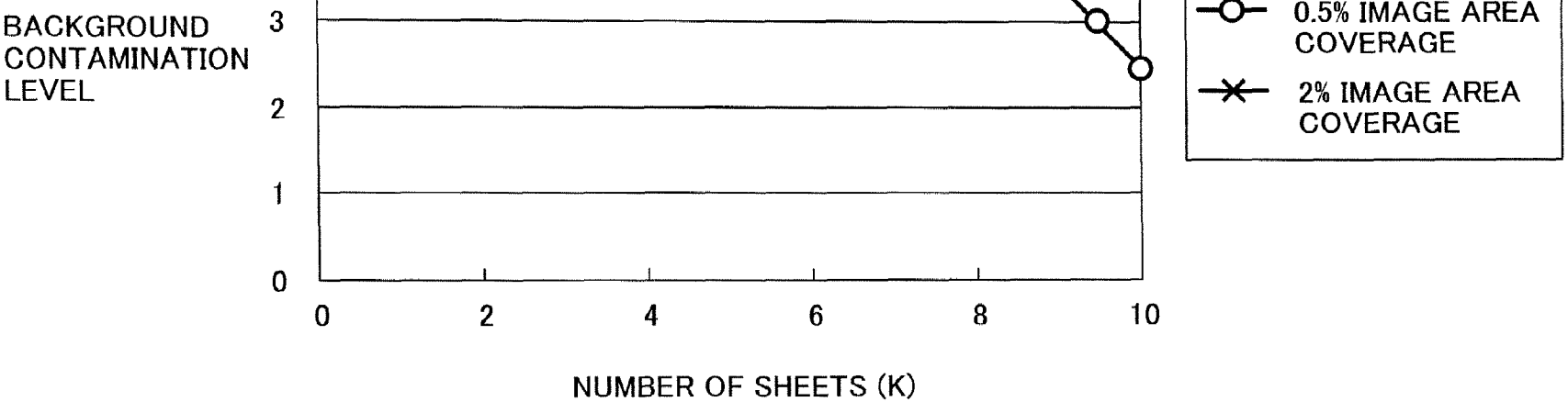
FIG. 7 is a graph showing background contamination levels according to the number of sheets processed by the developing devices of FIG. 2.

Referring to FIG. 7, results of an evaluation of background contamination are explained according to conditions of images reproduced on printout sheets. For the evaluation, two types of original images are used. One is an original image having a 0.5% image area coverage and the other is an original image having a 2% image area coverage. The color laser printer 10 used for the evaluation includes the developing device 10 having the structure as described above. The color laser printer 10 has reproduced the printout sheets of those original images to evaluate the background contaminations formed on the printout sheets focusing on an aging of the developing device 11 of the color laser printer 10. The evaluation results are rated on a scale of Grades 1 to 5. Grade 5 indicates a very good condition that the printout sheet contains the least background contamination. Grade 4 indicates a good condition that the printout sheet contains an acceptable amount of the background contamination. Grade 3 through Grade 1 indicate unacceptable conditions that the printout sheet has a greater amount of the background contamination than a predetermined acceptable amount thereof. As obviously seen from FIG. 7, the conditions of the printout sheets having the 2% image area coverage remain better or more acceptable than those having the 0.5% image area coverage even with a passage of age.

The background contamination occurs when a charge ability of the toner decreases or when a non-electrostatic adherence of the toner increases. When a small amount of toner is consumed, unused toner is repeatedly circulated in the developing device 11 in FIG. 3 and repeatedly passes the nip portion formed between the developing roller 20 and the doctor roller 22 in FIG. 3. The repetition increases stress applied onto the toner so that additive of the toner may be buried into a toner particle or isolated from the toner particle. As a result, the charge ability of the toner may decrease compared to that of new toner. Further, the non-electrostatic adherence of toner increases. This increases an amount of the toner which passes through the nip portion formed between the developing roller 20 and the doctor roller 22, resulting in producing a worse background contamination with age.

To reduce the background contamination, the developing device 11 consumes an appropriate amount of toner when the developing device 11 performs a substantially serial image forming operation for an original image having a low toner coverage. The operation above is referred to as a compulsory toner consumption.

The compulsory toner consumption may be performed at intervals of a predetermined volume of reproduction. The developing device 11 counts up the number of pixels of output images during a job of serially printing the image having a low toner coverage. After the predetermined volume of the reproduction is completed, the developing device 11 calculates an average rate of the image area coverage of the output images. When the average rate of the image area coverage is under a predetermined rate, an amount of toner compensating the difference between the average rate and the predetermined rate may be used for the compulsory toner consumption.

Further, the compulsory toner consumption is performed when the calculated average rate is smaller than the predetermined rate. Assuming the predetermined rate is 2%, when the average rate is calculated as 2% or more, the compulsory toner consumption is not performed. When the average rate is calculated as 0.5%, for example, the compulsory toner consumption is performed by an amount of toner corresponding to 1.5% pixels of output images calculated after the previous compulsory toner consumption. Therefore, the background contamination can be maintained in an acceptable level when sequentially printing out the image with the 0.5% area coverage.

In the non-image forming operation, the developing roller 20 performs the reverse rotation, rotates the doctor roller 22, and performs the developing rotation. During the developing rotation, the developing roller 20 transfers the calculated amount of toner onto the photoconductive belt 12. In synchronization with a movement of the developing roller 20, the photoconductive belt 12 is charged and exposed. The toner transferred onto the photoconductive belt 12 is collected by the photoconductive element cleaning unit 14.

When an amount of unnecessary toner used during the image forming operation is reduced, an amount of toner wasted due to the background contamination may be reduced and a total amount of toner consumption and the wasted toner may not substantially be increased. Therefore, the compulsory toner consumption contributes to a reduction of wasted toner.

The compulsory toner consumption may seem to be possibly performed in an operation other than the non-image forming operation of the developing device 11. However, the compulsory toner consumption needs to be performed while an image is not being formed. This may require a longer period of the non-image forming operation. To make the period of the non-image forming operation long without changing the printing speed, a process linear velocity needs to be increased, which deteriorates a durability of the developing device 11. Therefore, in the purpose of keeping the printing speed, the compulsory toner consumption is preferably performed during the non-image forming operation.

Figure 8:
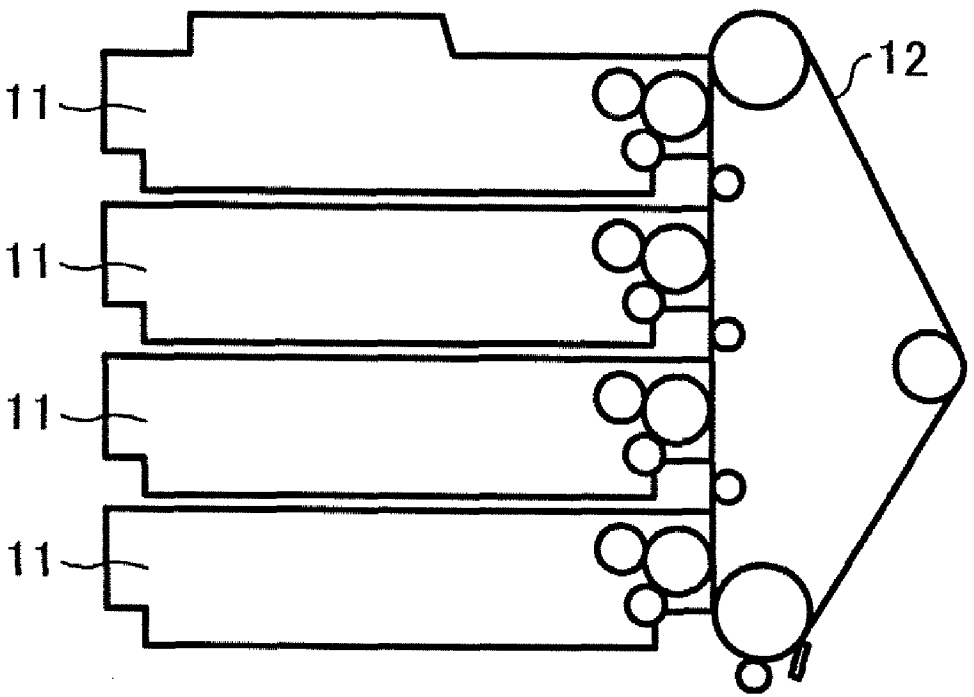
FIG. 8 is a vertical sectional view of a process cartridge included in the image forming apparatus of FIG. 2.

Referring to FIG. 8, a structure of a process cartridge which may be applied to the color laser printer 10 of FIG. 2 is described. The process cartridge may be integrally formed by the developing devices 11 and the photoconductive belt 12 of FIG. 2 and may be detachably provided to the color laser printer 10.

The above-described developing device using one-component toner and the process cartridge may be applied to an image forming portion (a photoconductive element, a charging unit, an exposing unit, a developing unit, a transfer unit and a fixing unit) of an electrophotographic color laser printer such as a copier, a printer, a facsimile machine and the like.

Numerous additional modifications and variations are possible in light of the above teachings. It is therefore to be understood that within the scope of the appended claims, the disclosure of this patent specification may be practiced otherwise than as specifically described herein.

What is claimed is:

1. A developing device, comprising:

a developing member configured to carry toner on a surface thereof and to perform a developing rotation during an image forming operation and a reverse rotation during a non-image forming operation, the range of rotation of the developing member being limited to a non-toner covered region in the reverse direction, where the surface of the developing member has a predetermined region where toner adheres to the surface of the developing member and the non-toner covered region; and a toner layer regulating member held in contact with the developing member and configured to regulate a layer of the toner on the surface of the developing member, the toner layer regulating member configured not to rotate with the developing member during the image forming operation and to rotate with the developing member during the non-image forming operation;

wherein the developing member is configured to perform the developing rotation immediately after termination of the non-image forming operation so as to perform a compulsory toner consumption to supply toner onto an image bearing member.

2. The developing device according to claim 1, further comprising means for counting up the number of pixels developed for output images during an interval, and for calculating an average image area coverage of the output images, wherein, during performance of the compulsory toner consumption, the developing member is configured to consume an amount of toner compensating for a difference between the average and a predetermined image area coverage.

3. A process cartridge, comprising:

an image bearing member configured to bear an image on a surface thereof; and a developing device including, a developing member configured to carry toner on a surface thereof, to perform a developing rotation during an image forming operation, and to perform a reverse rotation during a non-image forming operation, the range of rotation of the developing member being limited to a non-toner covered region in the reverse direction, where the surface of the developing member has a predetermined region where toner adheres to the surface of the developing member and the non-toner covered region, and a toner layer regulating member held in contact with the developing member and configured to regulate a layer of the toner on the surface of the developing member, the toner layer regulating member configured not to rotate with the developing member during the image forming operation and to rotate with the developing member during the non-image forming operation;

wherein the developing member is configured to perform the developing rotation immediately after termination of the non-image forming operation so as to perform a compulsory toner consumption to supply a predetermined amount of toner onto an image bearing member.

4. The process cartridge according to claim 3, wherein:

the developing device further comprises means for counting up the number of pixels developed for output images during an interval, and for calculating an average image area coverage of the output images, wherein, during performance of the compulsory toner consumption, the developing member is configured to consume an amount of toner compensating for a difference between the average and a predetermined image area coverage.

5. An image forming apparatus, comprising:

an image forming portion; and a developing device including, a developing member configured to carry toner on a surface thereof, to perform a developing rotation during an image forming operation, and to perform a reverse rotation during a non-image forming operation, the range of rotation of the developing member being limited to a non-toner covered region in the reverse direction, where the surface of the developing member has a predetermined region where toner adheres to the surface of the developing member and the non-toner covered region; and a toner layer regulating member held in contact with the developing member and configured to regulate a layer of the toner on the surface of the developing member, the toner layer regulating member configured not to rotate with the developing member during the image forming operation and to rotate with the developing member during the non-image forming operation, wherein the developing member is configured to perform the developing rotation immediately after termination of the non-image forming operation so as to perform a compulsory toner consumption to supply a predetermined amount of toner onto an image bearing member.

6. The image forming apparatus according to claim 5, wherein:

the developing device further comprises means for counting up the number of pixels developed for output images during an interval, and for calculating an average image area coverage of the output images, wherein, during performance of the compulsory toner consumption, the developing member is configured to consume an amount of toner compensating for a difference between the average and a predetermined image area coverage.

7. The image forming apparatus according to claim 5, wherein:

the image forming portion includes an image bearing member configured to bear an image on a surface thereof.

8. The image forming apparatus according to claim 5, wherein:

the image bearing member and the developing device are integrally mounted to a process cartridge.

* * * * *